US010407207B2

(12) United States Patent
Keefe, Jr.

(10) Patent No.: US 10,407,207 B2
(45) Date of Patent: Sep. 10, 2019

(54) SHIPPING CONTAINER CONVERTIBLE INTO A DISPLAY CONFIGURATION

(71) Applicant: International Paper Company, Memphis, TN (US)

(72) Inventor: Walter D. Keefe, Jr., Carol Stream, IL (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 699 days.

(21) Appl. No.: 14/978,404

(22) Filed: Dec. 22, 2015

(65) Prior Publication Data

US 2017/0174389 A1 Jun. 22, 2017

(51) Int. Cl.

| | |
|---|---|
| ***B65D 5/54*** | (2006.01) |
| ***B65D 5/355*** | (2006.01) |
| ***B65D 5/02*** | (2006.01) |
| ***B65D 77/04*** | (2006.01) |
| ***B65D 5/52*** | (2006.01) |

(52) U.S. Cl.

CPC ..... *B65D 5/5415* (2013.01); *B65D 5/0005* (2013.01); *B65D 5/02* (2013.01); *B65D 5/52* (2013.01); *B65D 5/542* (2013.01); *B65D 77/042* (2013.01)

(58) Field of Classification Search

CPC ..... B65D 5/5415; B65D 5/0005; B65D 5/02; B65D 5/0035; B65D 5/004; B65D 5/0015; B65D 5/16; B65D 5/322–324

USPC ..... 206/736–739, 45.28, 45.29, 774, 206/745–746, 751, 756; 229/123.2, 194, 229/235

See application file for complete search history.

(56) References Cited

U.S. PATENT DOCUMENTS

| | | | | |
|---|---|---|---|---|
| 1,110,853 A | | 3/1913 | Wolfe | |
| 1,216,071 A | * | 2/1917 | Carstensen | B65D 5/16 206/8 |
| 2,064,191 A | | 12/1936 | Brooks | |
| 2,334,985 A | | 11/1943 | Berry | |
| 2,450,035 A | * | 9/1948 | De Mian | B65D 5/0035 229/126 |
| 2,628,763 A | | 2/1953 | Frankenstein | |

(Continued)

FOREIGN PATENT DOCUMENTS

| | | |
|---|---|---|
| DE | 8902294 U1 | 9/1989 |
| GB | 2264101 A | 8/1993 |
| JP | 2008-132990 A | 6/2008 |

*Primary Examiner* — Robert Poon

(74) *Attorney, Agent, or Firm* — Matthew M. Eslami; Michael Folkerts; Thomas W. Ryan

(57) ABSTRACT

A shipping container convertible into a display configuration at a point of sale comprises a top wall, a bottom wall, side walls and end walls all of which are foldably joined to one another to form an interior space to receive product having a predetermined height. Each of the respective side walls includes a respective pair of spaced apart slots formed therein. Each of the end walls includes a respective minor top flap being foldably joined thereof. The respective minor top flaps include a pair of locking tabs each of which is engaged with the corresponding slots. A headspace is formed within the interior space of the container so as to compensate for the height of the products when the container is flipped on its side for displaybility at the point of sale and permits a user to remove product from various layers of containers stacked upon one another.

13 Claims, 7 Drawing Sheets

(56) References Cited

U.S. PATENT DOCUMENTS

| | | | | |
|---|---|---|---|---|
| 2,860,823 | A | 11/1958 | Frankenstein | |
| 3,368,735 | A | 2/1968 | Levi | |
| 3,450,347 | A | 6/1969 | Lewis et al. | |
| 3,499,597 | A | 3/1970 | Katzman | |
| 3,670,949 | A * | 6/1972 | Galanes | B65D 5/02 229/117.16 |
| 4,146,127 | A | 3/1979 | Bayer | |
| 4,366,916 | A * | 1/1983 | Guido | B65D 5/42 206/554 |
| 4,570,787 | A | 2/1986 | Forbes, Jr. | |
| 5,293,991 | A * | 3/1994 | Neumann | B65D 5/68 206/745 |
| 5,474,171 | A | 12/1995 | Niesen et al. | |
| 6,474,473 | B2 | 11/2002 | Wong | |
| 6,499,655 | B1 * | 12/2002 | Moen | B65D 5/322 229/120.24 |
| 6,691,869 | B2 * | 2/2004 | Knaack | B65D 5/5014 206/446 |
| 7,748,604 | B2 | 7/2010 | Keefe, Jr. et al. | |
| 2002/0179483 | A1 * | 12/2002 | Sears | A47F 5/112 206/541 |
| 2005/0150939 | A1 * | 7/2005 | Fakes | B65D 5/0227 229/235 |
| 2006/0278549 | A1 | 12/2006 | Kono et al. | |
| 2007/0256952 | A1 | 11/2007 | Kim-Gifford et al. | |
| 2010/0006456 | A1 * | 1/2010 | Bevier | B65D 5/0035 206/45.21 |
| 2012/0091031 | A1 * | 4/2012 | Pinkstone | B65D 5/0015 206/736 |
| 2013/0105355 | A1 | 5/2013 | Keefe | |

* cited by examiner

SHIPPING CONTAINER CONVERTIBLE INTO A DISPLAY CONFIGURATION

FIELD OF THE INVENTION

This invention relates generally to a corrugated paperboard container or tray for shipping and display products to the points of sale. More particularly, the invention is a shipping tray or container that is constructed on existing regular slotted container (RSC) case erector, filler, and sealer equipments and is convertible to a display tray or container at the point of sale.

BACKGROUND OF THE INVENTION

It is a common practice to load a quantity of individual packages of consumer products into corrugated paperboard shipping trays or containers for bulk shipment of the packages to another location and have the packages or product items then re-packed into a display tray or container for sale in retail or club stores. This results in both a significant expenditure of time on the part of the retailer in transferring the goods from the shipping containers to the display trays, as well as added expense in the form of shelving or display trays for such product items.

Although removal of individual product items from the shipping container and placing them individually on store shelving is suitable in some cases, the practice of displaying goods in shipping containers has become more popular with the advent of large warehouse style stores and supermarkets where the containers are stacked on top of one another on the retail floor.

In attempting to adapt a conventional shipping container for display of the product items held therein, a retailer might use a cutting implement to cut away a section of the shipping container to form an opening for display of and access to the product items. However, the use of cutting implements to open cases can damage the products and can weaken the container to the point that it cannot be safely stacked with other containers.

Accordingly, it would be desirable to have a shipping and display container that uses only a single piece of corrugated material in its construction, that can be easily produced on standard box plant converting equipment, that retains its integrity during shipping and handling, that does not require the use of a knife or other tool to convert it from a shipping to a display configuration, that leaves a clean smooth edge when opened.

SUMMARY OF THE INVENTION

The present invention provides a shipping tray or container that is easily convertible to a display configuration at a point of sale. The tray or container requires only a single piece of corrugated paperboard material in its construction and can be produced on standard box plant converting equipment. This would eliminate the need for the user to ship filled product items to another location and then have the product items emptied and then re-packed into a display tray. The invention uses the current tray former or filler or bottom flap sealer. When the tray moves out of the case filler, the top flaps are uniquely folded forming columns or beams that provide much needed package compression strength when the shipping tray or container is flipped on its side for pallet displayability. Furthermore, the top minor flaps of the tray or container provide a means to secure the front display lip (second major top flap) without glue or tape to secure the flaps closed. The other first major top flap is removed before the trays or containers are placed on the pallet for shipping. In addition, each of the top minor flaps or columns can be increased or decreased in size so as to obtain a desired tray or container width that would optimize the pallet footprint for shipping. In addition, headspace was built into the tray or container so as to allow the product access from all layers of the pallet display container.

This invention is unique in that the corrugated paperboard container can be die-cut, folded and glued on standard box plant equipment and is designed to provide a display option having the following attributes: (1) Eliminating the need for the user to ship filled product items to another location and then have the product items emptied and then re-packed into a display tray, (2) folding the top minor flaps to form stacking columns for compression purposes when the tray is flipped on its side for pallet displayability, (3) tucking the front display panel or the second major top flap behind the minor top flap (i.e., columns) to eliminate the needs of any fasteners such as tape or glue to keep the flaps in secured position, (4) adjusting the foldable columns to various sizes to obtain a desired tray width to maximize the pallet footprint, (5) purposely over-sizing the tray or the container to create headspace in the tray when the trays are stacked on its side permitting shoppers to take product items from any layer on the pallet display, and provide a practical and unique design appeal as compared to any other known corrugated tray designs available in the market place.

A further important consideration of the invention is economy of manufacture. Regular slotted container (RSC) has been known in the art of shipping containers for many years. The RSC is highly economical shipping container due to the fact that there is very little manufacturing waste. Further, due to its rectangular shape it is well suited to shipping products via cargo container, truck, train, or any other means of transport in which efficient use of space is a priority. As a result, RSC is widely used for shipping and storing many different types of products.

The RSC is formed from a single rectangular blank, typically of corrugated paperboard and have four rectangular sidewall panels. The RSC container has flaps on both the top and bottom edges of the sidewalls. In order to erect this container from a rectangular blank, four crush folds are made parallel to the depth of the container to define the four sidewall panels, and further crush folds are made parallel to the length and width of the container to define upper and lower flaps. This style of container is articulated by folding along the crush folds so that the sidewall panels are disposed at right angles to one another and the flap panels are folded inwardly to close the top and bottom of the RSC with the flaps associated with the shorter sides of the container being folded inwardly first, followed by the flaps associated with the longer sides. The flaps are then secured in closed position by any suitable means, such as tape, adhesive, staples, etc. The bottom side of RSC typically is closed first, the desired products are then inserted into the container, and the top side is then closed.

In many instances, especially in the so-called big container or box stores, the product packages are left in the shipping container which then also serves to support and display the packages for sale. If the shipping container is a conventional container or box the retailer must cut away a portion of the box in order to expose the product packages and provide access to them by the consumer. In order to provide a more attractive display and facilitate ease of use by the retailer, combination shipping and display containers have been developed which have sections that may be removed along perforated lines of weakness to expose the product packages and provide access to them.

Accordingly, one aspect of the present invention is directed to a shipping container convertible into a display configuration at a point of sale. The container comprises a top wall, a bottom wall, two side walls, and two end walls all of which are foldably joined to one another to form an interior space to receive product having a predetermined height. Each of the respective side walls includes a respective pair of spaced apart slots formed therein. Each of the respective end walls includes a respective Z-shaped column that is foldably joined thereof and in which each of the respective Z-shaped column includes a pair of locking tabs each of which is engaged with the corresponding slots on the respective side walls. A headspace is formed within the interior space of the container so as to compensate for the height of the products when the container is flipped on its side for displaying at the point of sale and permits a user to remove product from various layers of containers stacked upon one another without hindrance.

Another aspect of the present invention is directed to a shipping container convertible into a display configuration at a point of sale. The container comprises a top wall, a bottom wall, two side walls, and two end walls all of which are foldably joined to one another to form an interior space to receive product having a predetermined height. Each of the respective side walls includes a respective pair of spaced apart slots formed therein. A tear away panel having a first major top flap and a portion of one of the side walls is defined by perforated lines of weakness extending diagonally onto one of the side walls. The tear away panel is removed before the container is flipped on its side for a pallet or shelf display. Each of the end walls includes a respective minor top flap that is foldably joined thereof wherein the respective minor top flap forms a respective L-shaped column supported by one of the side walls when the container is flipped on its side for displaying at the point of sale. A headspace is formed within the interior space of the container so as to compensate for the height of the products when the container is flipped on its side for displaying at the point of sale and permits a user to remove product from various layers of containers stacked upon one another.

A further aspect of the present invention is directed to a shipping container convertible into a display configuration at a point of sale. The container comprises a top wall, a bottom wall, two side walls, and two end walls all of which being foldably joined to one another to form an interior space to receive product having a predetermined height. Each of the respective end walls includes a respective column being foldably joined thereof. The respective columns is supported by one of the side walls when the container is in the display configuration and in which the respective columns is capable of being changed in size so as to obtain a container width that corresponds to a pallet footprint for shipping. A headspace is formed within the interior space of the container so as to compensate for the height of the products when the container is flipped on its side for displaying at the point of sale and permits a user to remove product from various layers of containers stacked upon one another without hindrance.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
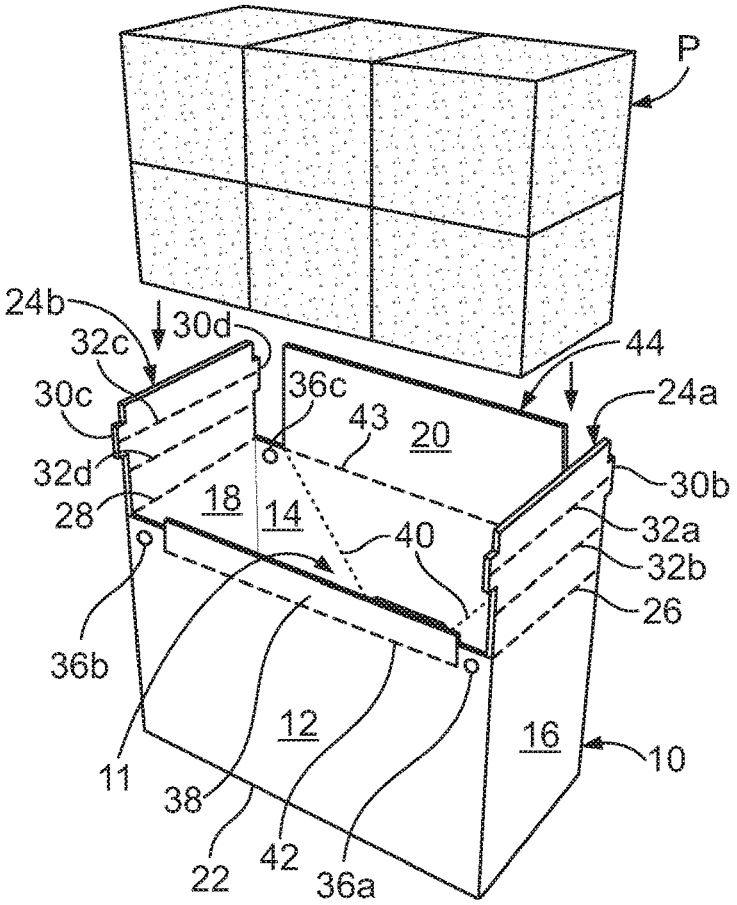
FIG. 1 is an exploded top perspective view of a partially folded container in accordance to a first embodiment of the invention, showing products in position to be placed inside of the container.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same. In addition, in accordance with the usual conventions regarding the illustration of blanks for paperboard or corrugated paperboard articles, and unless otherwise specified, broken or interrupted lines within the boundaries of a blank represent scores, perforations or other lines of weakness, and extended solid lines, on the interior of a blank represent cuts.

FIG. 1 is an exploded top perspective view of a partially folded container 10 in accordance to a first embodiment of the invention, showing products P in a position to be placed in the interior 11 of the container 10. The container 10 comprises a parallelepiped having opposite side walls 12 and 14, end walls 16 and 18, and top and bottom walls 20 and 22, respectively. The bottom wall 22 is defined by major and minor bottom flaps as will be discussed hereinafter. A respective minor top flaps 24*a* and 24*b* foldably extends from the respective end walls 16 and 18 defined by respective fold lines 26, 28. Each of the respective minor top flaps 24*a* and 24*b* includes a respective pair of tabs 30*a*, 30*b* and 30*c*, 30*d* each of which extends from the free opposed side edges thereof. The respective minor top flaps 24*a* and 24*b* are formed uniquely so as to be folded to form columns or beams that provide much needed package compression strength when the container 10 is flipped on its side for pallet displaybility. Each of the respective minor top flaps 24*a* and 24*b* is divided by respective fold lines 32*a*, 32*b* and 32*c*, 32*d* so that upon folding onto itself forming a respective Z-shaped columns 34*a*, 34*b* as seen best in FIG. 5. To securely hold the respective Z-shaped columns 34*a*, 34*b* in place, the respective tabs 30*a*, 30*b* and 30*c*, 30*d* are inserted to respective slots 36*a*, 36*b* and 36*c*, 36*d* formed on respective side walls 12 and 14. Two of the slots 36*a*, 36*b* are formed on the corner of the side wall 12 and they are spaced apart from one another. Similarly, the other two slots 36*c*, 36*d* are formed on the corner of the side wall 14 and they are spaced apart from one another. Second major top flap 38 foldably extends from respective side wall 12 via respective fold line 42. It should be noted that the first major top flap 20 is also denoted the top wall 20 which is separated from the container 10 via along perforated lines of weakness 40 extending diagonally in the side wall 14 before it is placed on the pallet for shipping as will be discussed hereinafter. The second major top flap 38 is formed on the side wall 12 and is defined by the fold line 42. The second major top flap 38 is folded at the right angle with respect to the side wall 12 and being held in that position by the respective Z-shaped columns 34*a*, 34*b*. When the container 10 is in the display position, the major top flap 38 is a lip used to prevent the products P from sliding and falling from the interior space 11.

Figure 2:
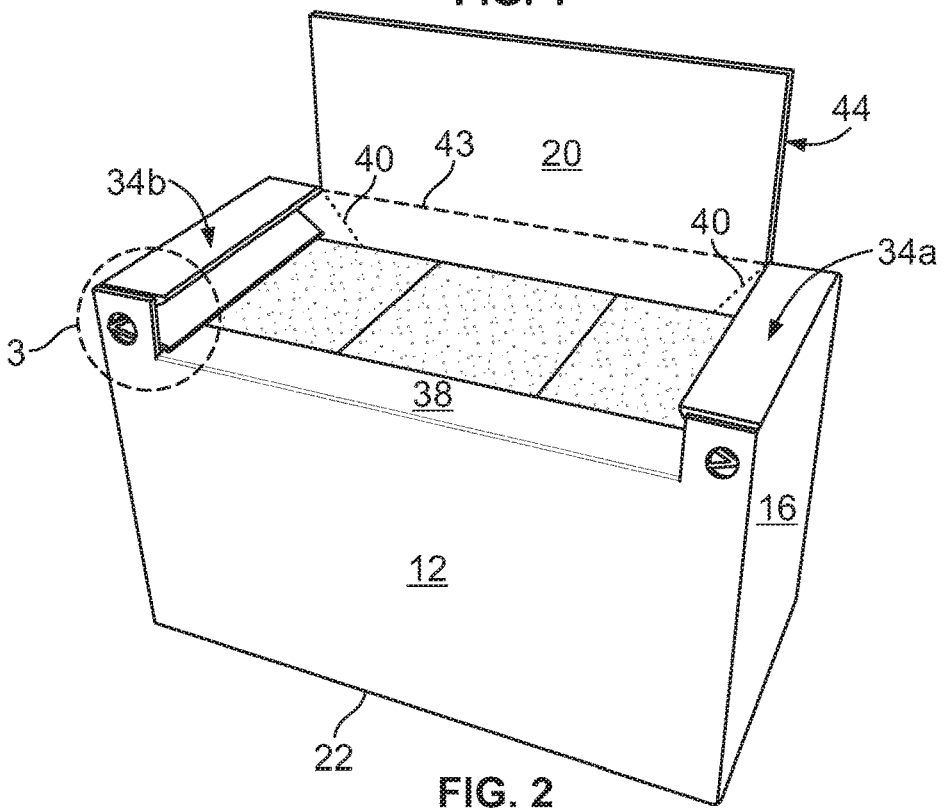
FIG. 2 is a top perspective view of the fully constructed container in FIG. 1 with the products disposed therein.
Figure 3:
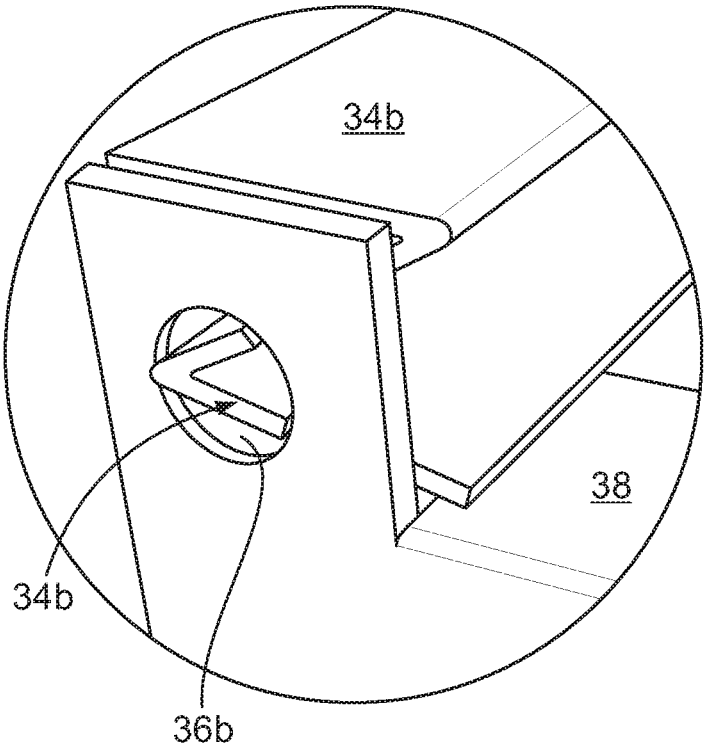
FIG. 3 is an enlarged view of a portion of the container in FIG. 2 illustrating the manner in which the top minor flaps are locked-in to form columns that provide compression strength when the container is flipped on its side.

FIG. 2 is a top perspective view of the fully constructed container in FIG. 1 with the products disposed therein. It should be noted that first the products are disposed in the interior space 11, then each of the respective minor top flaps 24*a* and 24*b* is folded onto itself forming the respective Z-shaped columns 34*a*, 34*b* and finally the respective tabs 30*a*, 30*b* and 30*c*, 30*d* are inserted to respective slots 36*a*, 36*b* and 36*c*, 36*d* as seen best in FIG. 3.

Figure 4:
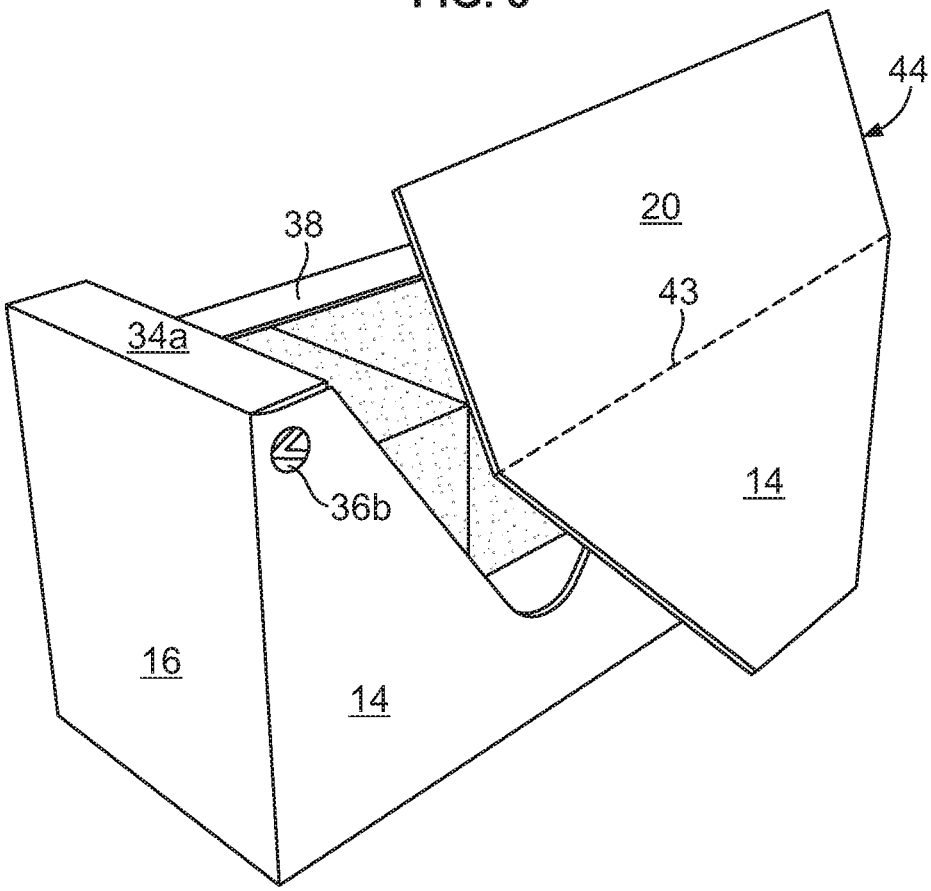
FIG. 4 is a front perspective view of the container when a tear away panel is removed and the display opening is in an upwardly facing orientation.

FIG. 4 is a front perspective view of the container 10 when a tear away panel 44 is removed and the display opening is oriented in an upwardly facing position. The tear away panel 44 includes the first top major flap 20 and a portion of the side wall 14 defined by the perforated lines of weakness 40 extending diagonally in the side wall 14. The major top flap 20 and the portion of the side wall 14 are foldably joined to one another by fold line 43. After removing the tear away panel 44, the container 10 or the display shipper is flipped on its side for pallet displaybility.

Figure 5:
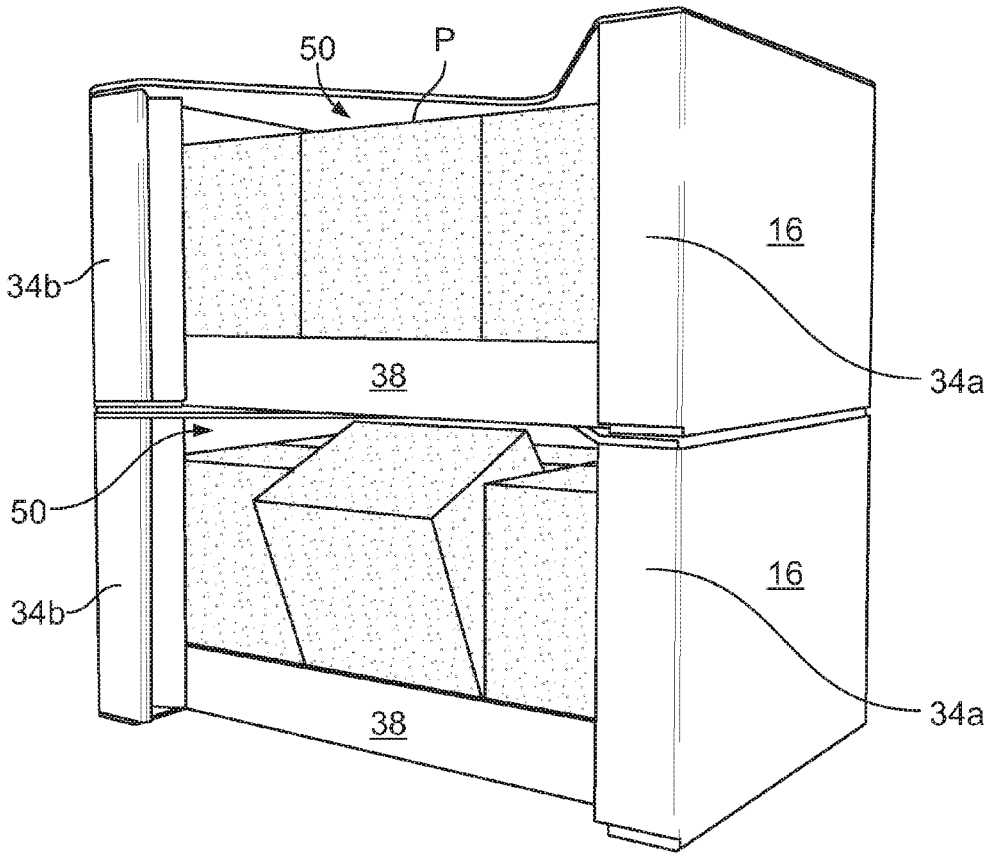
FIG. 5 is a front perspective view of the two stacked containers in accordance to the first embodiment of the invention, in its operative use position with the display opening in a forwardly facing orientation and wherein headspace is provided so that the products can be removed from all layers of the stacked containers.
Figure 13:
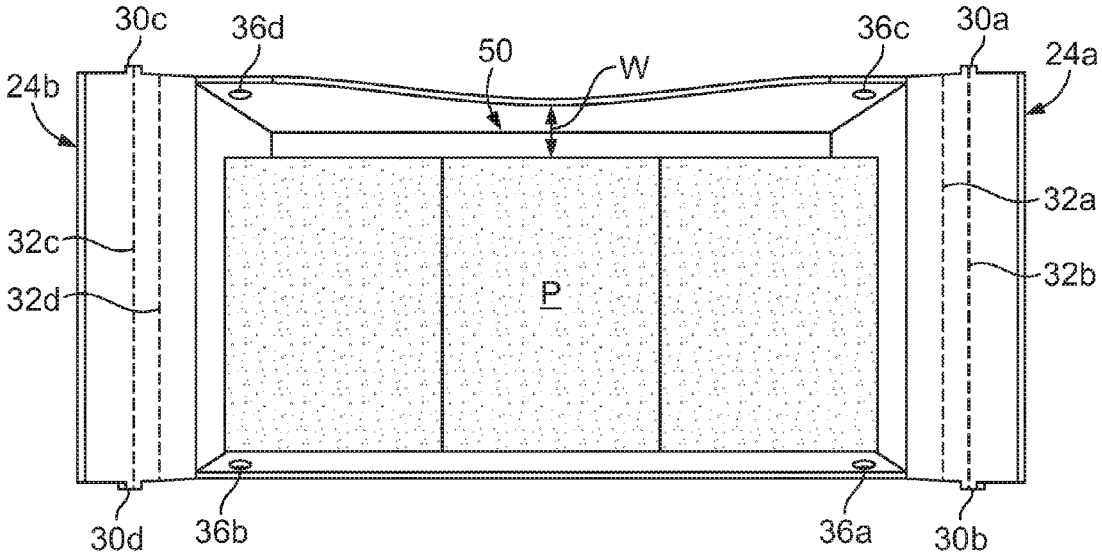
FIG. 13 is a top view of one of the containers in FIG. 5 illustrating the over-sizing the container with respect to the size of the products so as to form a headspace within the container.
Figure 14:
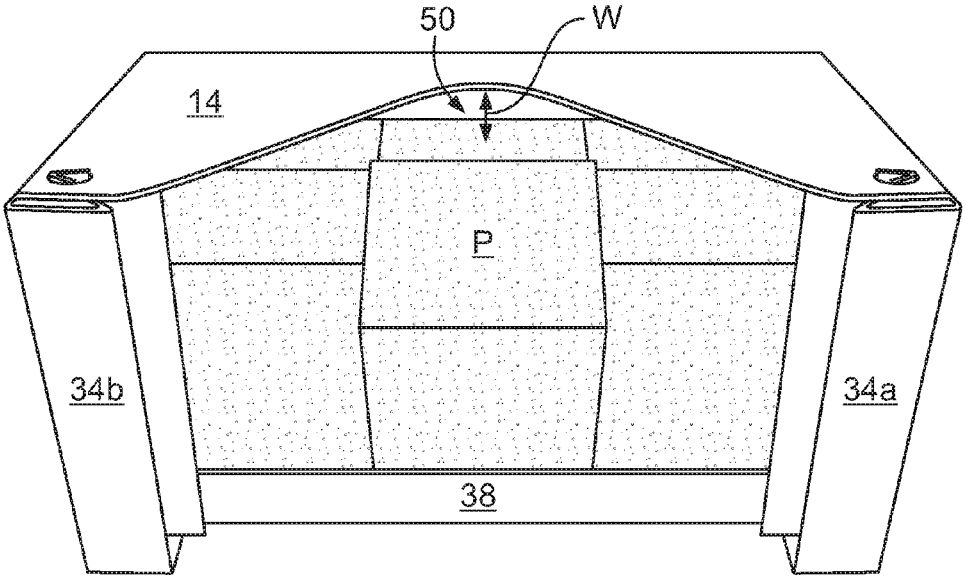
FIG. 14 is a front perspective view of an exemplary container in accordance to the first embodiment of the invention in its operative use position wherein a headspace is provided so that the products can be removed the container without impediment.

FIG. 5 is a front perspective view of the two stacked containers 10 in accordance to the first embodiment of the invention, in its operative use position with the display opening in a forwardly facing orientation. One of the advantages of the instant invention is that each of the stacked containers 10 permits a user to shop from any layer of the stacked containers since each container 10 includes a built-in headspace 50. As seen best in FIGS. 13 and 14, the built-in headspace 50 is formed by extending a width (W) of the interior space 11 so that the headspace 50 compensates for the height of the products when the container 10 is flipped on its side for displaybility at the point of sale. The width (W) is defined by the widths the bottom flaps and end walls.

The container 10 is made of a single piece of formable material such as, without limitation, corrugated containerboard and/or paperboard material. The container 10 is a display shipper that manufactured on the existing RSC case erector, filler and sealer equipments. The container 10 or display shipper is then placed on a pallet to be used as a full pallet display at any retail store and/or a club store. The container 10 or the display shipper 10 is particularly constructed so that users can remove products P from any layers of the stacked containers on the pallet. The container 10 or the display shipper eliminates the whole current practice used to have RSC's cases filled with products and then shipped to a secondary warehouse to be un-packed, then re-packed into a display shipper that is manually set-up. In the current practice the original case is then thrown away or re-cycled which is a huge waste and/or costly. Some of particular features of the instant invention are, but not limited to, the strong multi-corner beams or columns 34*a*, 34*b* on front side of the container when the container 10 is in its operative use position with the display opening in a forwardly facing orientation and a built-in headspace 50 that permits product shopping from all layers of the stacked containers. In addition, the size of minor top flaps 24*a*, 24*b* and/or, in turn, multi-corner beams or columns 34*a*, 34*b* can be increased or decreased so that to obtain a desired container width that would optimize the pallet footprint for shopping.

Figure 6:
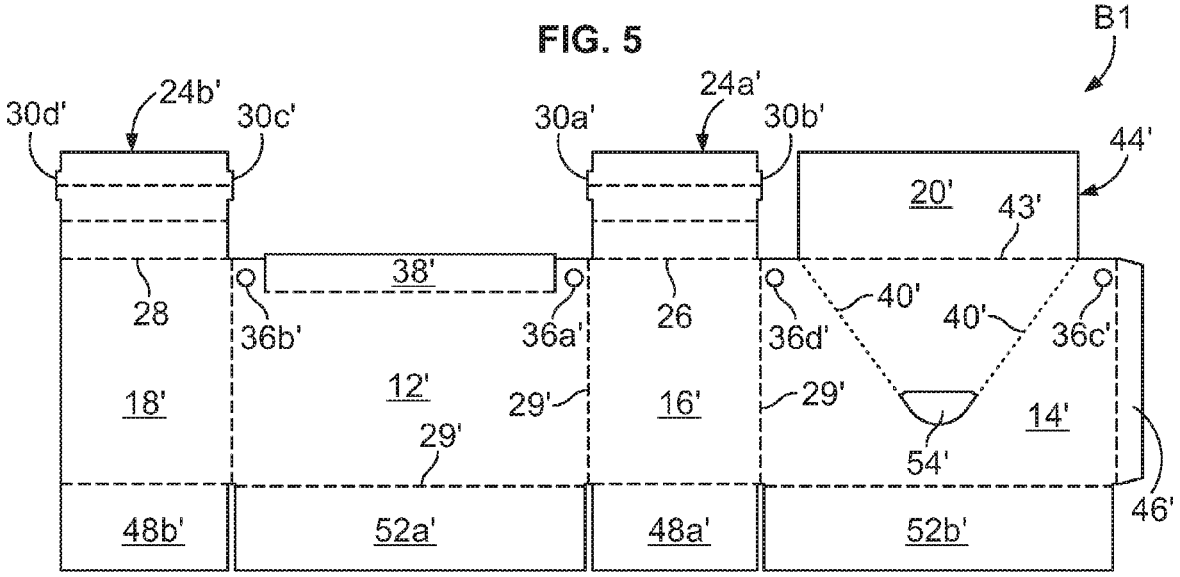
FIG. 6 is a plan view of a blank used in making the container in FIGS. 1-5 in accordance to the first embodiment of the invention.

FIG. 6 is a plan view of a blank B1 used in making the container in FIGS. 1-5, 13 and 14 in accordance to the first embodiment of the invention. The blank B1 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The blank B1 is cut and scored, perforated or otherwise formed to include a plurality of panels that when assembled form container 10. In all FIGURES, cut lines are shown as solid lines, score lines as dashed lines, and lines of perforation as broken lines. A series of fold scores 29 in the blank B1 define a second side wall panel 14' at a first end of the blank B1, a first end wall panel 16' adjoining the second side wall panel 14', a first side wall panel 12' adjoining the first end wall panel 16' along an edge opposite that edge joined to the second side wall panel 14', and a second end wall panel 18 adjoining the first side wall panel 12' along the edge opposite the first end wall panel 16'. A glue tab 46' is foldably joined to the edge of the second side wall panel 14 opposite the edge joined to the first end wall panel 16'.

Minor bottom flaps 48*a*' and 48*b*' are foldably joined to bottom edges of the end wall panels 16 and 18, respectively, and major bottom flaps 52*a*' and 52*b*' are foldably joined to bottom edges of the side wall panels 12' and 14', respectively.

A first major top flap 20' is foldably joined to the second side wall panel 14' along the edge opposite the edge to which the major bottom flap 52*b*' is attached. The length of the first major top flap 20' is smaller than the length of the second side wall panel 14'. A second major top flap 38' is foldably joined to the first side wall panel 12' along the edge opposite the edge to which the bottom major flap 52*a*' is attached. A first minor top flap 24*a*' is foldably joined to the end wall panel 16' opposite the edge to which the minor bottom flap 48*a*' is attached. A second minor top flap 24*b*' is foldably joined to the end wall panel 18' opposite the edge to which the minor bottom flap 48*b*' is attached. Two slots 36*a*', 36*b*' are formed in the side wall panel 12' adjacent the second major top flap 38' and two slots 36*c*, 36*d* are formed in the side wall panel 14' adjacent the first major top flap 20'. Respective locking tabs 30*a*', 30*b*' project from the respective free side edges of the first minor top flap 24*a*' and respective locking tabs 30*c*', 30*d*' project from the respective free side edges of the second minor top flap 24*b*'.

The line of perforations 40' extends diagonally across second side wall panel 14' from both end of the fold line 43' to the semi-circular cut-outs 54', defining a triangular panel. The semi-circular cut-outs 54' defines a finger access opening to enable a user's finger to be inserted for pulling out on the panels to separate the tear away panel 44' along the lines of perforation.

The steps for erecting the blank B1 to construct the container 10 by a folding machine are depicted in FIGS. 1-5. In FIG. 1 the container is shown opened up into a partially folded configuration and oriented with the top flaps up and the bottom flaps in folded position. Minor bottom flaps 48*a*, 48*b* are folded inwardly, followed by folding the two major bottom flaps 52*a* and 52*b* may be secured together in any suitable way, as by use of adhesive or other suitable fastener, but in the preferred embodiment a strip of tape T is applied over the two major bottom flaps 52*a* and 52*b*. Next, the major top flap 38 is folded inwardly at right angle with respect to the side wall 12 toward the interior space 11 and then each of the minor top flaps 24*a*, 24*b* is folded onto itself forming the respective Z-shaped columns 34*a*, 34*b* and inserted into the Respective locking tabs 30*a*, 30*b*, 30*c*, and 30*d*. The second major flap 38 is folded at the right angle with respect to the side wall 12 and being held in that position by the respective Z-shaped columns 34*a*, 34*b*. It will be noted that prior to converting the container 10 to its display configuration the tear away panel 44 is removed and the container 10 is flipped so that such the side wall 12 would be the bottom of the container 10. The loaded stacked containers 10 is placed on a pallet then shipped in the orientation shown in FIG. 5 to the point of the sale.

A second embodiment of the invention is indicated generally at 54 in FIGS. 7-12. This embodiment of the invention is substantially similar to the first embodiment described hereinabove, except that the minor top flaps are substantially different in both of the embodiments.

Figure 10:
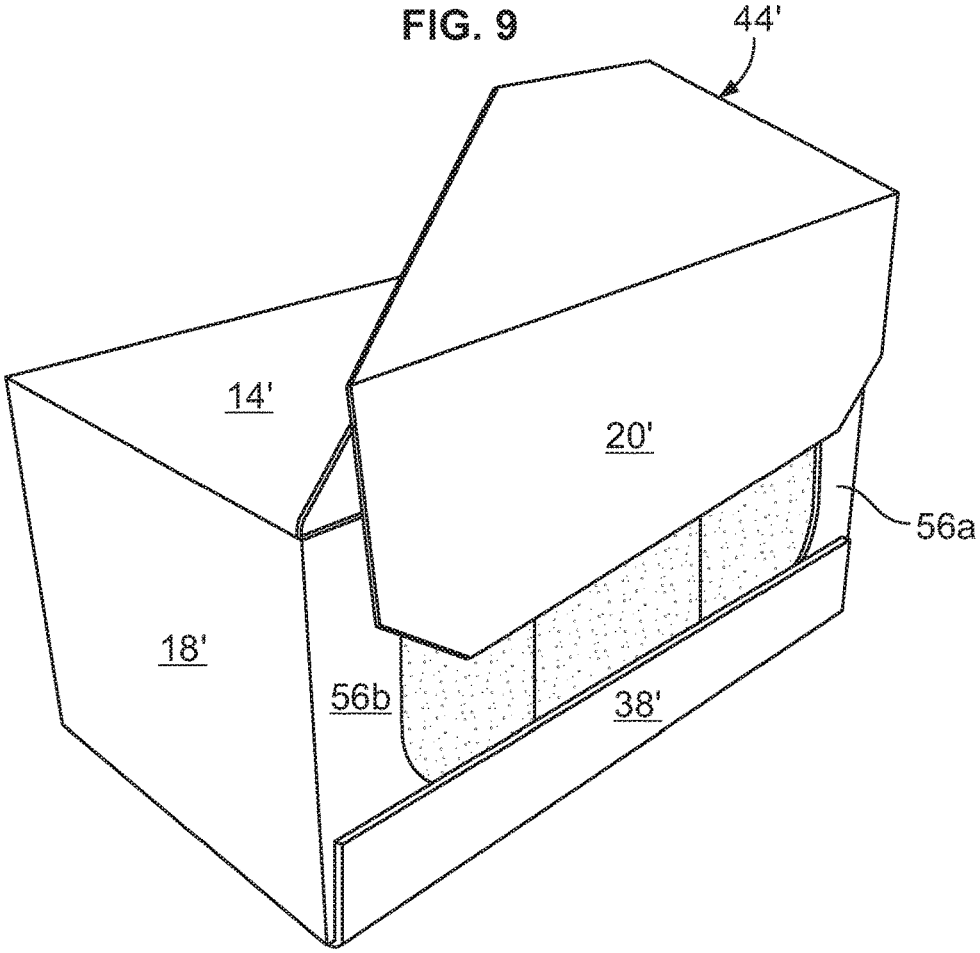
FIG. 10 is a front perspective view of the container when a tear away panel is removed and the display opening in a display position.
Figure 11:
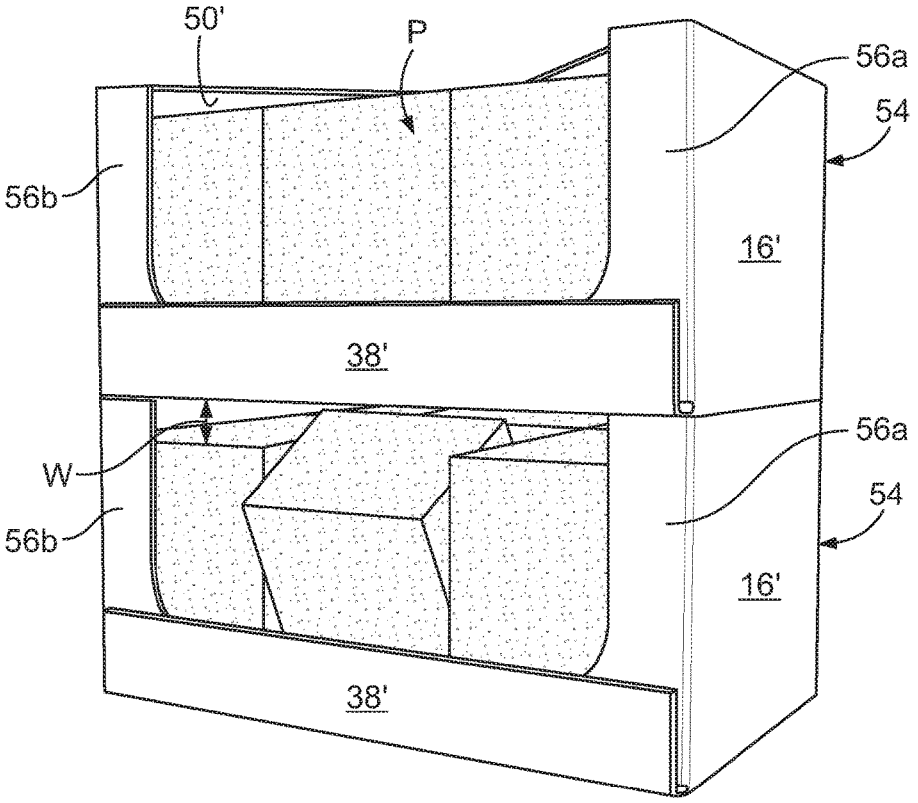
FIG. 11 is a front perspective view of the two stacked containers in accordance to the second embodiment of the invention in its operative use position wherein headspace is provided so that the products can be removed from all layers of the stacked containers.
Figure 12:
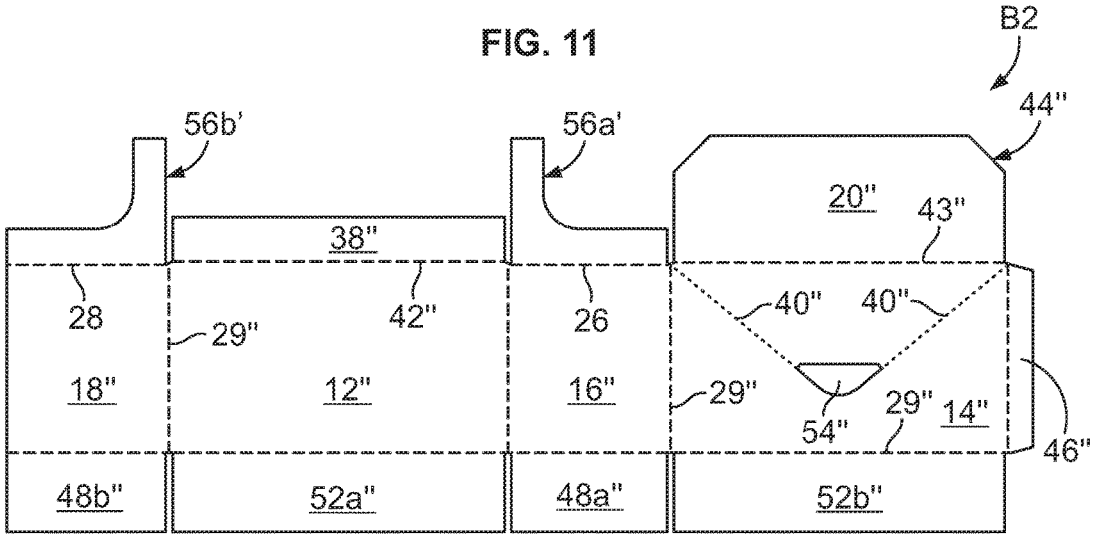
FIG. 12 is a plan view of a blank used in making the container in FIGS. 7-11 in accordance to the second embodiment of the invention.

FIG. 12 is a plan view of a blank B2 used in making the container 54 in FIGS. 7-11 in accordance to the second embodiment of the invention. The blank B2 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The blank B2 is cut and scored, perforated or otherwise formed to include a plurality of panels that when assembled form container 10'. A series of fold scores 29' in the blank B2 define a second side wall panel 14" at a first end of the blank B2, a first end wall panel 16" adjoining the second side wall panel 14", a first side wall panel 12" adjoining the first end wall panel 16" along an edge opposite that edge joined to the second side wall panel 14", and a second end wall panel 18" adjoining the first side wall panel 12" along the edge opposite the first end wall panel 16". A glue tab 46" is foldably joined to the edge of the second side wall panel 14" opposite the edge joined to the first end wall panel 16".

Minor bottom flaps 48*a*" and 48*b*" are foldably joined to bottom edges of the end wall panels 16" and 18", respectively, and major bottom flaps 52*a*' and 52*b*' are foldably joined to bottom edges of the side wall panels 12" and 14", respectively.

A first major top flap 20" is foldably joined to the second side wall panel 14" along the edge opposite the edge to which the major bottom flap 52*b*" is attached. The length of the first major flap 20" is the same as the length of the second side wall panel 14'. A second major top flap 38" is foldably joined to the first side wall panel 12" along the edge opposite the edge to which the major bottom flap 52*a*" is attached. A first L-shaped minor top flap 56*a*' is foldably joined to the end wall panel 16" opposite the edge to which the minor bottom flap 48*a*" is attached. A second L-shaped minor top flap 56*b*' is foldably joined to the end wall panel 18" opposite the edge to which the minor bottom flap 48*b*" is attached. In the folded position, the respective first and second L-shaped minor top flap 56*a*', 56*b*' is folded at the right angle with respect to the fold line 29" toward the interior space 11'. The respective first and second L-shaped minor top flap 56*a*', 56*b*' forms a respective L-shaped column when they are in folded position.

The line of perforations 40" extends diagonally across second side wall panel 14" from both end of the fold line 43" to the semi-circular cut-outs 54", defining a triangular panel. The semi-circular cut-outs 54" defines a finger access opening to enable a user's finger to be inserted for pulling out on the panels to separate the tear away panel 44" along the lines of perforation.

Figure 7:
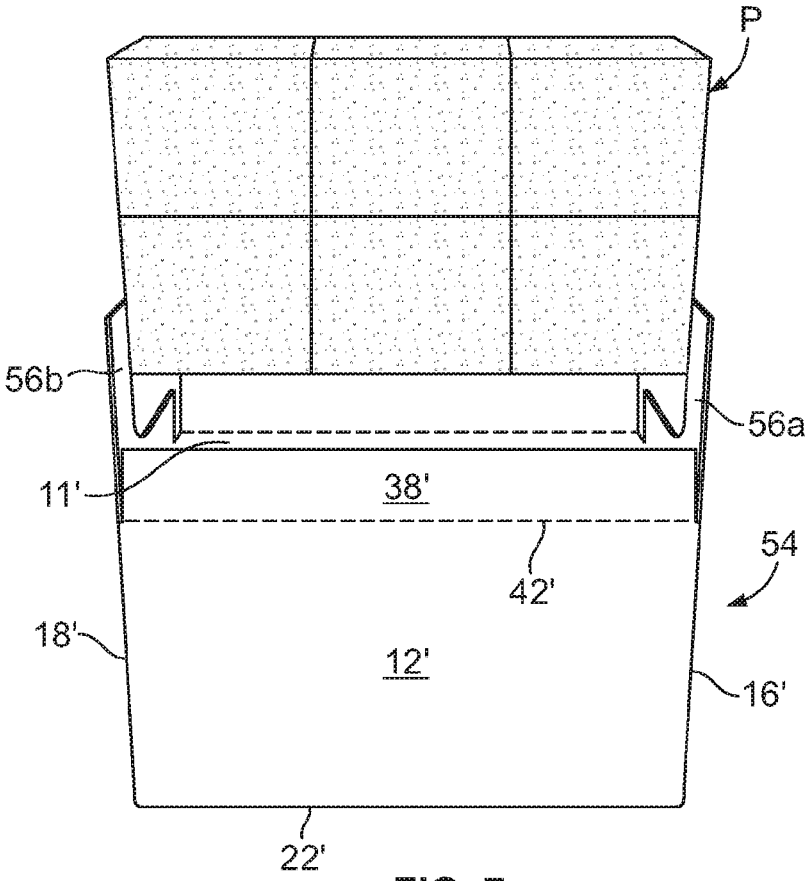
FIG. 7 is an exploded top perspective view of a partially folded container in accordance to a second embodiment of the invention, showing products in position to be placed inside of the container.

The steps for erecting the blank B2 to construct the container 54 are depicted in FIGS. 7-11. In FIG. 7 the container 54 is shown opened up into a partially folded configuration and oriented with the top flaps up and the bottom flaps in folded position. After the products P are disposed in the container 54, minor bottom flaps 48*a*", 48*b*" are folded inwardly, followed by folding the two major bottom flaps 52*a*" and 52*b*" be secured together in any suitable way, as by use of adhesive or other suitable fastener, but in the preferred embodiment a strip of tape T is applied over the two major bottom flaps 52*a*" and 52*b*". Next, the respective first and second L-shaped minor top flap 56*a*', 56*b*' is folded at the right angle with respect to the fold line 29" toward the interior space 11", the first major top flap 20" is folded over at right angle with respect to the fold line 43" toward the interior space. And finally, the second major top flap 38" is folded over the respective first and second L-shaped minor top flap 56*a*', 56*b*' and a strip of tape T is applied over the length of the second major top flap 38" and downwardly over the respective end wall panels 16" and 18". It will be noted that prior to converting the container 54 to its display configuration the tear away panel 44" is removed and the container 54 is flipped so that such the side wall 12' would be the bottom of the container 54. The loaded stacked containers 54 is placed on a pallet then shipped in the orientation shown in FIG. 11 to the point of the sale.

Returning to FIGS. 7-11 and particularly to FIG. 7, which is an exploded top perspective view of a partially folded container 54 in accordance to a second embodiment of the invention in which showing the products P in a position to be placed in the interior 11' of the container 54. The container 54' comprises a parallelepiped having opposite side walls 12' and 14', end walls 16' and 18', and top and bottom walls 20' and 22'. The bottom wall 22' is defined by major and minor bottom flaps as will be discussed hereinafter. A respective L-shaped minor top flap 56*a* and 56*b* foldably extends from the respective end walls 16' and 18' defined by respective fold lines 26', 28'. Each of the respective L-shaped minor flaps 56*a* and 56*b* are formed uniquely so as to be folded to form columns that provide much needed package compression strength when the container 54 is flipped on its side for pallet or shelf display. Second major top flap 38' foldably extends from respective side wall 12' via fold lines 42'. It should be noted that the first major top flap 20' is also denoted the top wall 20 which is separated from the container 54 via along perforated lines of weakness 40 extending diagonally in the side wall 14' before it is placed on the pallet for shipping as will be discussed hereinafter. The second major top flap 38' is formed on the side wall 12' and is defined by the fold line 42. The second major top flap 38' is folded at the right angle with respect to the side wall 12 and being held in that position in any suitable way, but in preferred embodiment a strip of tape T is applied over the length of the second major top flap 38" and downwardly over the respective end wall panels 16" and 18". When the container 54 is in the display position, the second major top flap 38' is a lip used to prevent the products P from sliding and falling from the interior space 11'.

Figure 8:
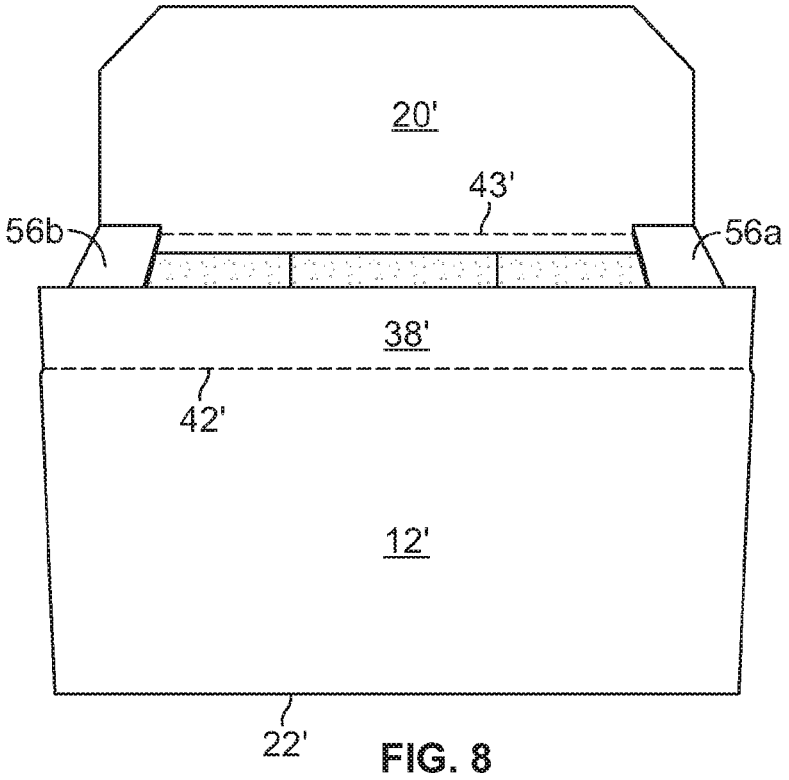
FIG. 8 is a top perspective view of the partially folded container in FIG. 7 with the products disposed therein.
Figure 9:
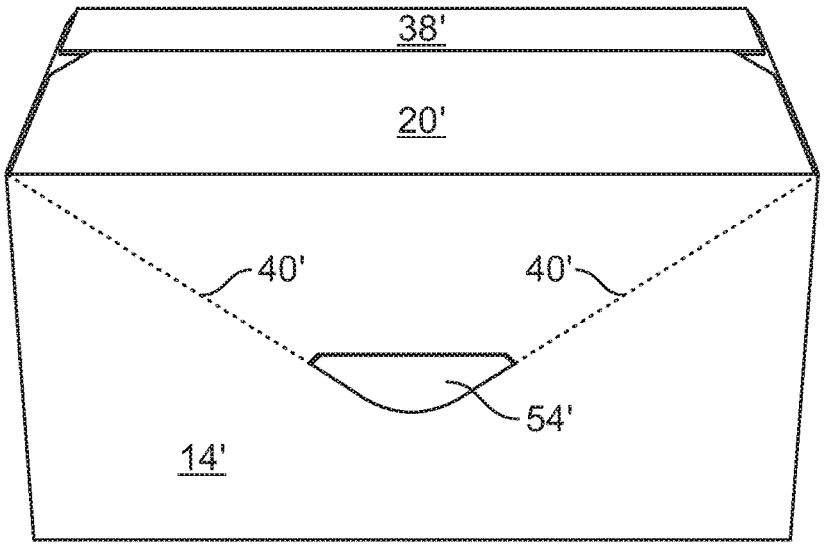
FIG. 9 is a top perspective view of the fully constructed container in FIG. 8 with the enclosed products for shipment to a point of sale.

FIGS. 8 and 9 is a top perspective view of the fully constructed container in FIG. 7 with the products disposed therein. It should be noted that the products are disposed in the interior space 11, then each of the respective minor top flaps 56*a* and 56*b* is folded at the right angle toward the interior space 11', the first top major flap 20' is overlapped on the minor top flaps 56*a* and 56*b* and then the second major top flap 38' is fold over both of the first major top flap 20' and the respective minor top flaps 56*a* and 56*b*.

FIG. 10 is a front perspective view of the container 54 when a tear away panel 44' is removed and the display opening is oriented in a forwardly facing position. The tear away panel 44' includes the major top flap 20' and a portion of the side wall 14' defined by the perforated lines of weakness 40' extending diagonally in the side wall 14'. The major top flap 20' and the portion of the side wall 14' are foldably joined to one another by fold line 43'. After removing the tear away panel 44' the container 54 or the display shipper is placed a pallet for shipment to the point of sale.

FIG. 11 is a front perspective view of the two stacked containers 54 in accordance to the second embodiment of the invention, in its operative use position with the display opening in a forwardly facing orientation. As noted above, one of the advantages of the instant invention is that each of the stacked containers 54 permits a user to shop from any layer of the stacked containers since each container 54 includes a built-in headspace 50'. As seen best in FIGS. 13 and 14, the built-in headspace 50' is formed by extending a width (W) of the interior space 11' so that the headspace 50' compensates for the height of the products when the container 54 is flipped on its side for displaybility at the point of sale.

The container 54 is made of a single piece of formable material such as, without limitation, corrugated containerboard and/or paperboard material. The container 54 is a display shipper that manufactured on the existing RSC case erector, filler and sealer equipments. The container 54 or display shipper is then placed on a pallet to be used as a full pallet display at any retail store and/or a club store. The container 54 or the display shipper 54 is particularly constructed so that users can remove products P from any layers of the stacked containers on the pallet. The container 54 or the display shipper eliminates the whole current practice used to have RSC's cases filled with products and then shipped to a secondary warehouse to be un-packed, then re-packed into a display shipper that is manually set-up. In the current practice the original case is then thrown away or re-cycled which is a huge waste and/or costly. Some of particular features of the instant invention are, but not limited to, the strong corner beams 56*a*, 56*b* on front side of the container when the container 54 is in its operative use position with the display opening in a forwardly facing orientation and a built-in headspace 50' that permits products P shopping from all layers of the stacked containers 54. In addition, the size of minor top flaps or corner beams 56*a*, 56*b* can be increased or decreased so that to obtain a desired container width that would optimize the pallet footprint for shopping. The columns are formed into Z-shaped and L-shaped since testing the container for compression strength denotes these two shapes significantly improve the compression strength.

It should now be appreciated that the present invention provides a material-saving, quickly erected container or the display shipper especially useful in retaining, transporting variety of products to retail stores.

Numerous modifications and variations on the present invention are possible in light of the above teachings. It is, therefore, to be understood that within the scope of the accompanying claims, the invention may be practiced otherwise than as specifically described herein.

While the invention has been described with reference to a preferred embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A shipping container convertible into a display configuration at a point of sale comprising:

a top wall, a bottom wall, two opposite side walls, and two end walls all of which being foldably joined on a single blank of material to form an interior space to receive product having a predetermined height, each of the side walls includes a respective pair of spaced apart slots formed therein;

each of the end walls includes a respective Z-shaped column being foldably joined thereto wherein each Z-shaped column includes a pair of locking tabs adjacent to the opposite side walls, each locking tab being engaged with a corresponding slot in an adjacent side wall; and a major top flap that is foldably joined to one of the side walls, the major top flap folded at a right angle with respect to said one of the side walls and locked behind the Z-shaped columns to form a front display lip when the container is positioned for display of product located within the interior space by flipping the container on its side for a pallet or shelf display.

2. The container of claim 1 further comprising a tear away panel having a first major top flap, wherein said major top flap that is foldably joined to one of the side walls comprises a second major top flap, and a portion of one of the side walls defined by perforated lines of weakness extending diagonally on one of the side walls.

3. The container of claim 2 wherein the tear away panel is removed before the container is flipped on its side for a pallet or shelf display.

4. The container of claim 1 wherein each of the respective Z-shaped column is formed by a respective minor top flap that is divided by a plurality of fold lines in which upon folding onto itself forms the respective Z-shaped column that provides compression strength when the container is flipped on its sides for pallet or shelf display.

5. The container of claim 4 wherein each of the Z-shaped columns includes a size that is capable of being increased or decreased so as to obtain a container width that corresponds to a pallet footprint for shipping.

6. A shipping container in combination with a product and convertible into a display configuration at a point of sale comprising:

a top wall, a bottom wall, a first side wall and a second side wall opposite from the first side wall, and two end walls all of which being foldably joined on a single blank of material to form an interior space to receive product having a predetermined height;

a first major top flap foldably joined to the second side wall and a second major top flap foldably joined to the first side wall, wherein the first major top flap is removable and the second major top flap is located at a lower front side of a display opening for the container when the container is converted to a display configuration oriented in a position resting on the first side wall;

each of the end walls includes a respective column being foldably joined thereto wherein the respective columns being supported by one of the side walls when the container is in the display configuration and wherein the respective columns is capable of being changed in size so as to obtain a container width that corresponds to a pallet footprint for shipping;

a headspace defined between the opposite side walls within the interior space of the container so as to compensate for the height of the products when the container is flipped on its side and the first major top flap is removed for displaying at the point of sale and permits a user to remove product from various layers of containers stacked upon one another without hindrance; and each of the side walls includes a respective pair of spaced apart corresponding slots formed therein, wherein each of the respective columns includes a pair of locking tabs each of which is engaged with the corresponding slots on the side walls.

7. The container of claim 6 further comprising a tear away panel formed by the first major top flap and a portion of the second side wall defined by perforated lines of weakness extending diagonally onto the second side wall wherein the tear away panel is removed before the container is flipped on its side for a pallet or shelf display.

8. The container of claim 6 wherein each of the respective columns is formed by a respective minor top flap that is divided by a plurality of fold lines in which upon folding onto itself forms a respective Z-shaped column that provides compression strength when the container is flipped on its sides for pallet or shelf display.

9. The container of claim 1 wherein the front display lip includes an inward facing side facing toward the interior space and an opposite outward facing side engaged by the Z-shaped columns.

10. The container of claim 4 wherein each minor top flap forming a respective Z-shaped column comprises a first section folded at a right angle to a respective adjacent end wall at a first fold line, a second section folded toward the respective adjacent end wall at a second fold line, and a third section folded away from the respective adjacent end wall at a third fold line.

11. The container of claim 10 wherein the first, second, and third sections are successively folded upon each other and are spaced from an adjacent section to form the respective Z-shaped column.

12. The container of claim 8 wherein each minor top flap forming a respective Z-shaped column comprises a first section folded at a right angle to a respective adjacent end wall at a first fold line, a second section folded toward the respective adjacent end wall at a second fold line, and a third section folded away from the respective adjacent end wall at a third fold line.

13. The container of claim 12 wherein the first, second, and third sections are successively folded upon each other and are spaced from an adjacent section to form the respective Z-shaped column.

* * * * *